US006406266B1

(12) United States Patent
Hugenroth et al.

(10) Patent No.: US 6,406,266 B1
(45) Date of Patent: Jun. 18, 2002

(54) MOTOR PROTECTOR ON NON-ORBITING SCROLL

(75) Inventors: Jason Hugenroth, Hope; Edward A. Tamayko; Thomas Barito, both of Arkadelphia, all of AR (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 09/527,428

(22) Filed: Mar. 16, 2000

(51) Int. Cl.[7] ..... F04B 49/06; F04B 49/00; F04B 49/10

(52) U.S. Cl. ..... 417/44.1; 417/18

(58) Field of Search ..... 417/44.1, 18, 32

(56) References Cited

U.S. PATENT DOCUMENTS 5,118,260 A * 6/1992 Fraser et al. ..... 417/18
5,169,294 A * 12/1992 Barito ..... 417/310
5,200,872 A * 4/1993 D'Entremont et al. ..... 361/25
5,368,446 A * 11/1994 Rode ..... 417/18
5,509,786 A * 4/1996 Mizutani et al. ..... 417/32

FOREIGN PATENT DOCUMENTS

JP 7-35080 * 2/1995

* cited by examiner

*Primary Examiner*—Charles G. Freay
*Assistant Examiner*—Michael K. Gray
(74) *Attorney, Agent, or Firm*—Carlson, Gaskey & Olds

(57) ABSTRACT

An inventive scroll compressor has its motor protector circuit mounted on the compressor pump unit. In this way, increased temperature from reverse rotation of the orbiting scroll causes the motor protector unit to quickly stop operation of the motor. Preferably, the motor protector unit is mounted on the non-orbiting scroll.

22 Claims, 4 Drawing Sheets

MOTOR PROTECTOR ON NON-ORBITING SCROLL

BACKGROUND OF THE INVENTION

This invention relates to placing an electric motor protection device on the non-orbiting scroll in a scroll compressor to stop operation of the motor should adverse conditions be detected.

Scroll compressors are widely utilized in modern refrigerant compression applications. In a scroll compressor, a pair of scroll members each include a base and a generally spiral wrap extending from the base. The wraps interfit to define compression chambers. One of the two members is caused to orbit relative to the other, and the size of the compression chambers is decreased. An entrapped refrigerant is compressed, and moves to a discharge port which extends through the base of one of the scroll members.

There are many challenges with the design of scroll compressors. In particular, scroll compressors are designed to orbit in only one direction. If the orbiting scroll is caused to orbit in a direction reverse from the design direction, then refrigerant is drawn into the discharge port and moved toward a suction port. This is undesirable, and can cause excessive heat around the scroll members.

Scroll compressors have been proposed with protection elements to address this reverse rotation, and other problems. In particular, the electric motor is often provided with a protector circuit. The protector circuit incorporates electronics which respond to excessive current or voltage, and excessive heat. Historically, the protector circuit is incorporated into the electric motor, and adjacent to the stator windings.

Protector circuits have been proposed which are placed within the refrigerant flow adjacent to the discharge port. These protector circuits are connected to the electric motor. Should the discharge refrigerant exceed a maximum temperature, the protector circuits will then stop operation of the motor.

However, reverse rotation does not necessarily affect the temperature of the discharge refrigerant. In reverse rotation, as mentioned above, the refrigerant is drawn into the discharge port. The discharge chamber refrigerant is not heated excessively. However, the compressor pump unit is heated excessively, and undesirably.

One other prior art system locates a portion of a motor sensor on the non-orbiting scroll. This sensor is then wired into series with the motor protection circuit on the motor. However, the sensor does sense the temperature of the refrigerant in the discharge port. Further, it is undesirable to have two separate protector circuits as the complexity and expense increases.

In one major cause for such reverse rotation, the windings of the three phase electrical motor are improperly connected such that the phases are reversed. In such a situation, it is desirable for the protector circuit to quickly stop operation of the motor. The earliest, and most reliable indication of reverse rotation is excessive heat at the pump unit. The prior art protector circuits are not designed to respond to such feedback.

SUMMARY OF THE INVENTION

In a disclosed embodiment of this invention, a motor protector circuit is connected into the electric motor circuit for a scroll compressor. The protector circuit may be as utilized in the prior art; however, it is preferably mounted on the base of the non-orbiting scroll. In this way, the protector circuit is operable to respond to temperatures in the compressor pump unit, and quickly stop operation of the motor should reverse rotation occur. The current and voltage are still sensed by the motor protection circuit. Thus, electrical anomalies which have typically tripped the motor protector circuit when mounted on the motor are still sensed by the inventive motor protector circuit, and the motor is still stopped should there be an excessive electrical quantity passing through the motor protector circuit.

Preferably, the motor protector circuit is sealed from the discharge pressure refrigerant. The motor protector circuit is preferably mounted into a recess in an outer face of the base of the non-orbiting scroll. In a first embodiment, a separator plate is utilized in conjunction with the non-orbiting scroll. The separator plate separates the compressor housing into discharge and suction pressure chambers. In this embodiment, a simple plastic coating electrically insulates the motor protector circuit from the surrounding environment.

In a second embodiment, the separator plate is eliminated. In this embodiment, the shell of the compressor is secured to the non-orbiting scroll, and a seal between the two is provided. In this embodiment, a plastic cover is again mounted to electrically insulate the protector circuit from the non-orbiting scroll. Further, a sealing cap seals the recess which receives the protector such that the protector is sealed from a discharge pressure chamber defined on one side of the non-orbiting scroll.

Stated another way, the motor protector is within the axial length of the compressor pump unit. In preferred embodiments, the motor protector is mounted on the base of the non-orbiting scroll. However, the motor protector could be mounted on the crankcase, or even on the inner periphery of the housing for the compressor.

These and other features of the present invention can be best understood from the following specification and drawings, the following of which is a brief description.

DETAILED DESCRIPTION OF A PREFERRED EMBODIMENT

Figure 1A:
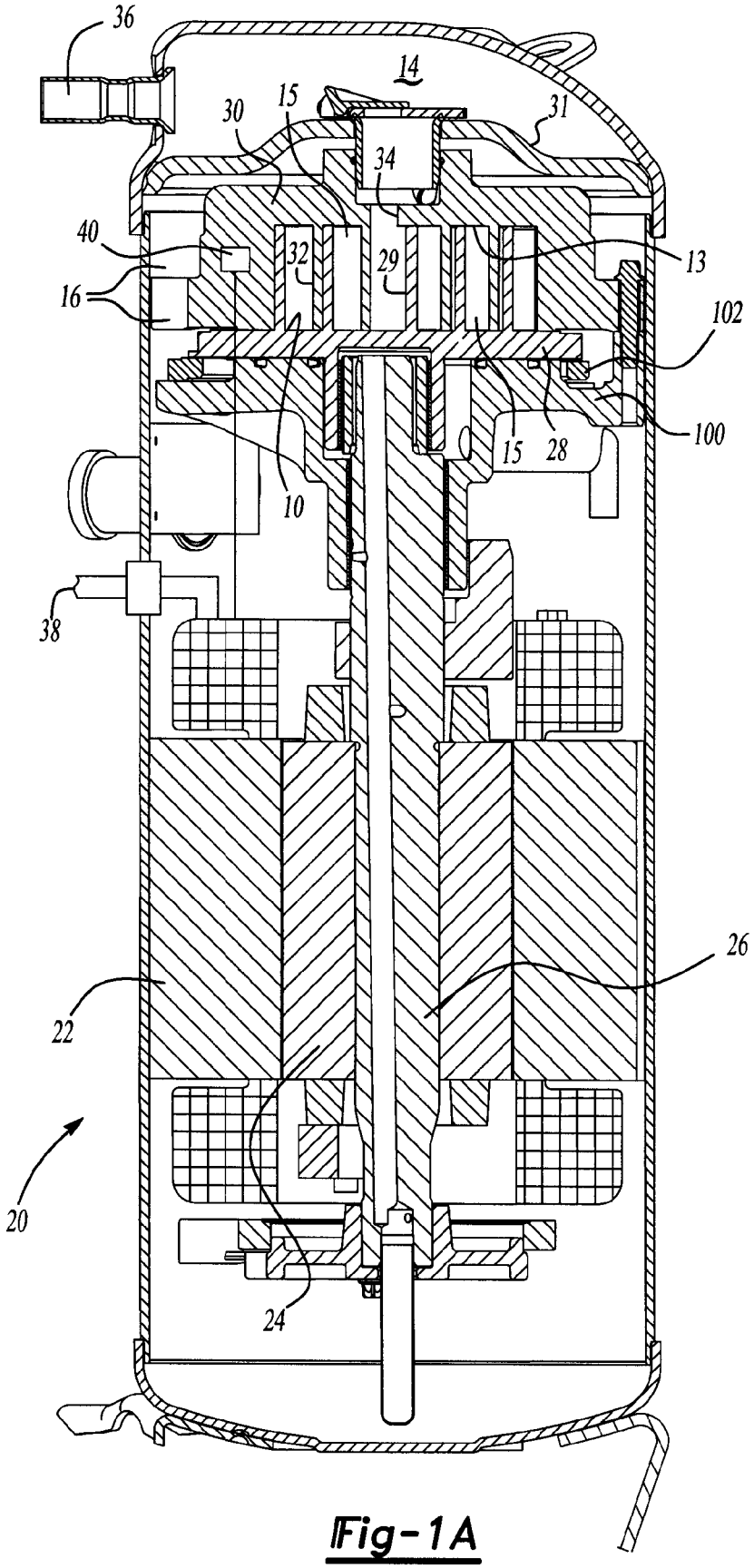
FIG. 1A is a cross sectional view of a scroll compressor schematically incorporating the present invention.

A scroll compressor 20 is illustrated in FIG. 1A having an electric motor stator 22 and an electric motor rotor 24. As known, the rotor 24 drives a shaft 26. The shaft 26 drives an orbiting scroll 28 to orbit through an anti-rotation coupling 102. The orbiting scroll 28 has wraps 29 extending from a base 11 interfitting with wraps 32 extending from a base 13 on a non-orbiting scroll 30 to define compression chambers 15. In the illustration, the non-orbiting scroll 30 is shown as fixed; however, this invention also extends to non-orbiting scrolls wherein the orbiting scroll is allowed to move through a limited axial distance. A separator plate 31 separates the compressor 20 into suction 16 and discharge pressure chambers 14. A crankcase 100 supports the orbiting scroll 28.

A discharge port 34 extends through the non-orbiting scroll 30, and communicates to a discharge chamber 14 and then discharge tube 36. In the past, motor protector circuits have been proposed which would sense the temperature of this refrigerant. However, such a location does not provide as accurate an indication of reverse rotation as would be desirable. An example of such a prior art system is shown in U.S. Pat. No. 5,118,260. The basic circuitry of the motor protector circuit as shown in this patent is incorporated by reference. Such a motor protector circuit can be utilized in the present invention; however, as will be disclosed below, the location is preferably changed. Other protector circuits which respond to both excessive heat and electrical anomalies to stop operation of an electric motor could be used.

In the present invention, an electric power supply 38 includes three phase power leading to the motor stator 22. As is known, this electric power supply may sometimes be miswired such that the motor would cause the shaft 26 to rotate in the reverse direction from that which is desirable. This is most undesirable for a scroll compressor.

The combination of the orbiting scroll 28, the non-orbiting scroll 30, the crankcase 100 and the anti-rotation coupling 102 may be referred to as a compressor pump unit. Most preferably, the inventive motor protector unit 40 is mounted in the compressor pump unit, and electrically connected to the stator 22. The location is shown schematically in this view. Again, the electrical connections and controls may be as shown in U.S. Pat. No. 5,118,260, or may be other appropriate controls. It is the location of the protector unit which is inventive here. Most preferably, the protector circuit 40 is mounted on the non-orbiting scroll.

In the event there is an electrical anomaly with the power being supplied to the motor stator 22, the protector unit 40 will sense the anomaly and stop operation of the motor 22. If a condition exists such that the pump unit becomes excessively hot (e.g., reverse running, loss of refrigerant charge, outdoor fan failure), the high temperature will be sensed by the protector circuit 40, which will again stop operation of the motor 22.

FIG. 1A shows this basic invention somewhat schematically.

Figure 1B:
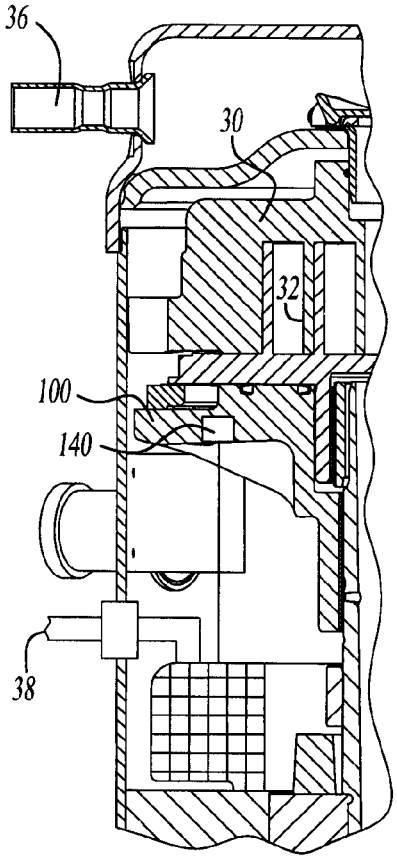
FIG. 1B is another location for the motor protector unit.

FIG. 1B shows a motor protector 140 mounted on the crankcase 100. Again, this would provide an indication of the temperature of the compressor pump unit, which is a good indication of the state of operation of the compressor. The protector unit 140 would operate similar to the protector unit 40.

Figure 1C:
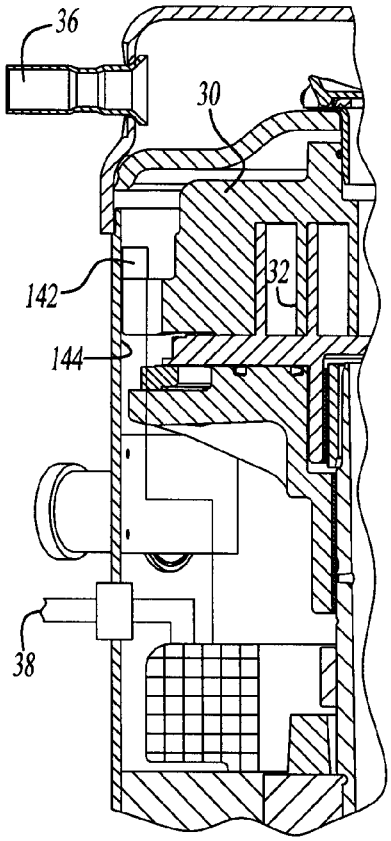
FIG. 1C shows yet another location for the motor protector unit.

FIG. 1C shows yet another embodiment motor protector 142 mounted on the inner periphery of a center housing 144. The embodiments 1A through C could all be characterized as having a motor protector which also controls the motor for electrical anomalies, and wherein the motor protector is mounted within the axial length of the compressor pump unit. The compressor pump unit is defined as including the non-orbiting scroll, the crankcase, the anti-rotation coupling, and the orbiting scroll. By placing the motor protector within the axial length of the compressor pump unit, it is ensured it is close to the compressor pump unit such that it is sensitive to temperature feedback.

Figure 2:
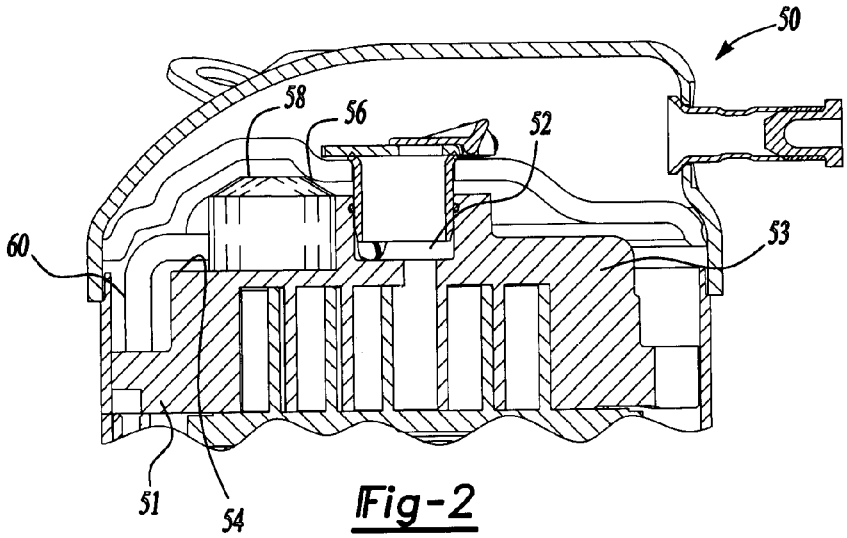
FIG. 2 is a cross sectional view of a scroll incorporating a first embodiment of this invention.

FIG. 2 shows a scroll 50 having the non-orbiting scroll 51 incorporating a discharge port 52. This embodiment 50 is to be incorporated in a scroll having a separator plate such as the plate shown in the FIG. 1A embodiment separating the discharge and suction pressure chambers. In this embodiment, a recess 54 is defined into the base 53 of the non-orbiting scroll 51. The recess has a radially inner edge or end wall 56. The motor protector circuit 58 sits within the recess 54. Wires 60 lead to the motor stator 22. The electronic details of the motor protector 58 may be as known. As known, a plastic cover preferably covers the motor protector circuit 58 such that the motor protector circuit 58 is electrically isolated from the non-orbiting scroll 51.

Figure 3:
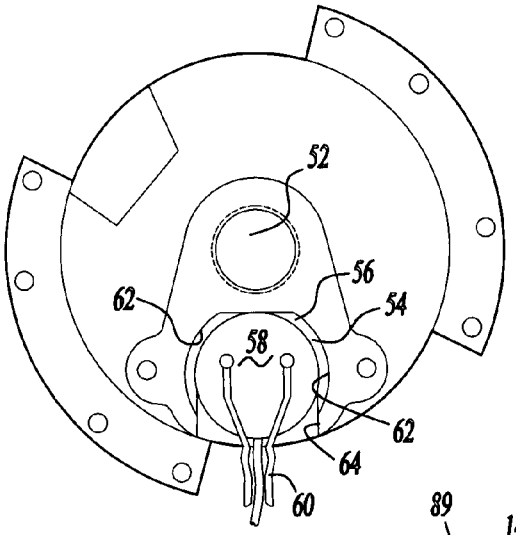
FIG. 3 is a top view of the FIG. 2 embodiment.

FIG. 3 shows further details including the motor protector circuit 58 positioned within the recess 54. As shown, the wires 60 extend along a radially outer surface of the non-orbiting scroll to the motor. Side walls 62 connect the end wall 56 to an opening 64 in the recess 54.

As can be appreciated, in this position, the motor protector circuit 58 senses the temperature of the non-orbiting scroll.

Figure 4:
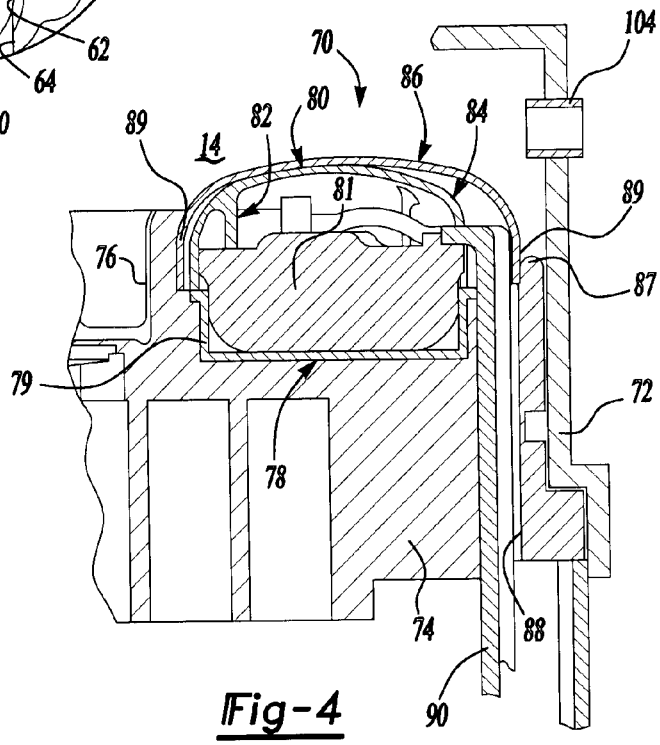
FIG. 4 shows a second embodiment.

Another embodiment 70 is illustrated in FIG. 4. In embodiment 70, the outer housing 72 is sealed to the non-orbiting scroll 74, such that an area or chamber 14 above the non-orbiting scroll 74 is at discharge pressure due to compressor refrigerant leaving the port 76. A discharge tube 104 extends through housing 72. That is, there is no separator plate.

A recess 78 receives a first portion 79 of a plastic isolation portion and a cap 80 is positioned above portion 79. Together the two provide electrical isolation for the motor protector circuit 81. A circumferentially extending rib, or legs 82 from the cap 80 abuts a top of the protector circuit 81. A forward cover 84 extends to an opening through which the wires 90 extend to the motor. As shown, the wires 90 extend through an opening 88 extending through the base of the non-orbiting scroll 74. A seal cap 86 seals the recess 78 from the discharge pressure chamber above the non-orbiting scroll 74. Preferably cap 86 is formed from drawn steel. As shown, the cap 86 has outer surface 89 which is received tightly within a recess outer periphery 87 in the non-orbiting scroll 74. Thus, the chamber which receives the motor protector circuit 81 is sealed from the discharge pressure refrigerant.

Figure 5:
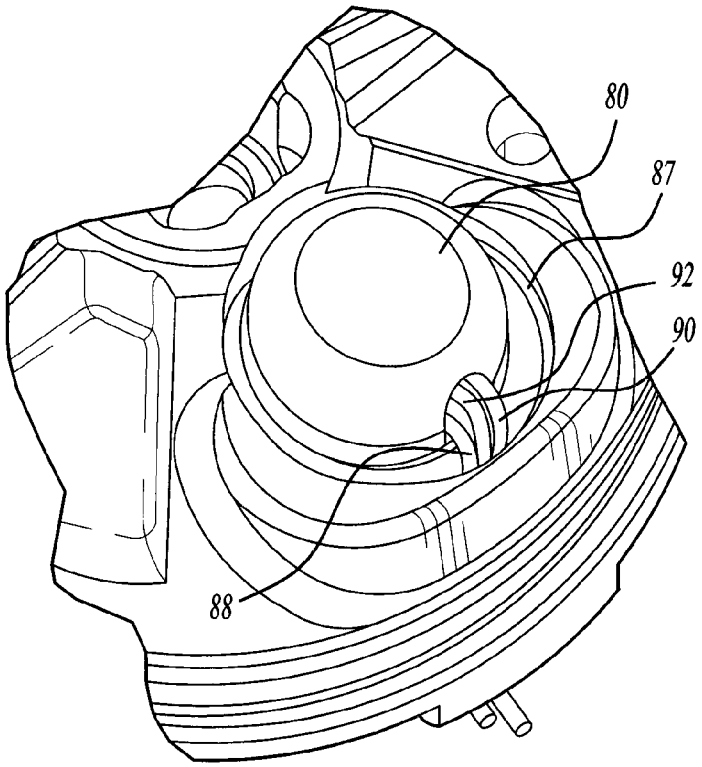
FIG. 5 shows another view of the FIG. 4 embodiment.

As shown in FIG. 5, the seal cap 86 is removed showing only the plastic cap 80.

Figure 6:
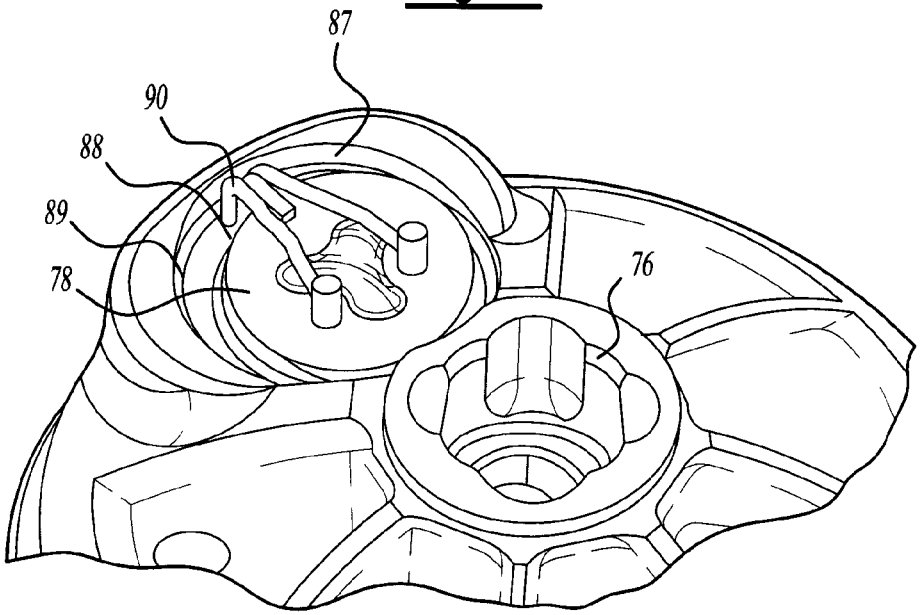
FIG. 6 shows yet another view of the FIG. 4 embodiment.

FIG. 6 shows the removal of the plastic cover cap 80. As can be seen, the wires 90 extend through the openings 88. The inventive positioning of the motor protector circuit in this location ensures a prompt response from the motor protector circuit 78 in the event that abusive running conditions produce excessive pump unit heat.

In general, the present invention discloses a unique location for the motor protector circuit which allows the system to quickly respond to undesirable conditions in the scroll compressor such as reverse rotation. The present invention provides greater assurance that the motor will stop under adverse conditions than the prior art, and further provides a very simple and effective protective circuit.

A preferred embodiment of this invention has been disclosed; however, a worker in this art would recognize that certain modifications come within the scope of this invention. For that reason, the following claims should be studied to determine the true scope and content of this invention.

What is claimed is:

1. A scroll compressor comprising,:

an electric motor receiving an electric power supply;

a shaft driven to rotate by said electric motor, said shaft being operable to drive an orbiting scroll to orbit, a non-orbiting scroll interfitting with said orbiting scroll, an anti-rotation coupling to constrain said orbiting scroll to orbit and a crankcase supporting said orbiting scroll, said orbiting and non-orbiting scrolls each including a generally spiral wrap extending from a base, said wraps interfitting to define compression chambers; and a motor protector circuit being electrically connected to sense conditions in the operation of said electric motor and said compressor pump unit and selectively stop operation of said electric motor, said motor protector circuit being mounted on one of said orbiting scroll, said non-orbiting scroll, said anti-rotation coupling and said crankcase.

2. A scroll compressor as recited in claim 1, wherein said motor protector circuit is mounted on a base of said non-orbiting scroll.

3. A scroll compressor as recited in claim 1, wherein said motor protector circuit is positioned in a recess in said base of said non-orbiting scroll.

4. A scroll compressor as recited in claim 3, wherein said motor protector circuit is positioned in a chamber which is sealed from a discharge pressure chamber.

5. A scroll compressor as recited in claim 4, wherein a separator plate is positioned between said discharge pressure chamber and said non-orbiting scroll.

6. A scroll compressor as recited in claim 4, wherein a seal cap is positioned in said base of said non-orbiting scroll to seal a discharge pressure chamber from said motor protector circuit.

7. A scroll compressor as recited in claim 6, wherein wires extend from said motor protector circuit to said motor, through a passage through said base of said non-orbiting scroll.

8. A scroll compressor as recited in claim 6, wherein a separate plastic cover sits between said cap and said motor protector circuit.

9. A scroll compressor as recited in claim 8, wherein said separate plastic cover includes a leg securing said motor protector circuit.

10. A scroll compressor as recited in claim 1, wherein wires extend from said motor protector circuit to said motor, said wires extending outwardly of an outer radial surface of said non-orbiting scroll.

11. A scroll compressor as recited in claim 10, wherein a recess for receiving said motor protector circuit includes a radially inner face, side walls extending from said radial inner face, and a radially outward opening, said wires extending through said radially outward opening.

12. A scroll compressor as recited in claim 1, wherein said motor protector circuit is mounted in said crankcase.

13. A scroll compressor comprising:

an electric motor receiving an electric power supply;

a shaft driven to rotate by said electric motor, said shaft being operable to drive a compressor pump unit, said compressor pump unit incorporating an orbiting scroll to be driven to orbit by said shaft, and a non-orbiting scroll, said orbiting and non-orbiting scrolls each including a generally spiral wrap extending from a base, and said wraps interfitting to define compression chambers;

a discharge port extending through said base of said non-orbiting scroll, said discharge port communicating with a discharge chamber, and refrigerant being compressed in said compression chambers passing through said discharge port to said discharge chamber; and a motor protector circuit being electrically connected to sense condition in the operation of said electric motor and said compressor pump unit and selectively stop operation of said electric motor, said motor protector circuit being mounted on base of said non-orbiting scroll to sense the temperature of said base of said non-orbiting scroll.

14. A scroll compressor as recited in claim 13, wherein said motor protector circuit is sealed from discharge chamber.

15. A scroll compressor comprising:

an electric motor receiving an electric power supply;

a shaft driven to rotate by said electric motor, said shaft being operable to drive a compressor pump unit defined as including an orbiting scroll driven to orbit by said shaft and a non-orbiting scroll, each of said orbiting and non-orbiting scrolls each including a generally spiral wrap extending from said base, and said wraps interfitting to define compressor chambers; and a discharge pressure chamber communicating with a discharge port extending through said base of said non-orbiting scroll, and a separator element for separating said discharge pressure chamber from a suction pressure chamber, said electric motor being received in said suction pressure chamber, and a motor protector circuit for sensing conditions in said electric motor and in said non-orbiting scroll, and selectively stopping operation of said electric motor, said motor protector circuit being mounted on a base of said non-orbiting scroll and being sealed from said discharge pressure chamber.

16. A scroll compressor as recited in claim 15, wherein said motor protector circuit is positioned in a recess in an outer face of said base of said non-orbiting scroll.

17. A scroll compressor as recited in claim 15, wherein said separator element is provided by said non-orbiting scroll.

18. A scroll compressor as recited in claim 15, wherein said separator element is a plate positioned between said discharge chamber and said base of said non-orbiting scroll.

19. A scroll compressor comprising:

an electric motor receiving an electric power supply;

a shaft driven to rotate by said electric motor, said shaft being operable to drive an orbiting scroll to orbit, a non-orbiting scroll interfitting with said orbiting scroll, an anti-rotation coupling to constrain said orbiting scroll to orbit, and a crankcase for supporting said orbiting scroll, said orbiting and non-orbiting scrolls each including a generally spiral wrap extending from a base, said wraps interfitting to define compression chambers; and a motor protector circuit being electrically connected to sense conditions in the operation of said electric motor and said compressor pump unit and selectively stop operation of said electric motor, an axial length defined by the axial location of said orbiting scroll, said non-orbiting scroll, said anti-rotation coupling and said crankcase, and said motor protector circuit being mounted within said axial length.

20. A scroll compressor as recited in claim 19, wherein said motor protector unit is mounted on said non-orbiting scroll.

21. A scroll compressor as recited in claim 19, wherein said motor protector unit is mounted on said crankcase.

22. A scroll compressor as recited in claim 19, wherein said motor protector is mounted on a inner face of a housing which surrounds said compressor pump unit.

* * * * *

UNITED STATES PATENT AND TRADEMARK OFFICE

CERTIFICATE OF CORRECTION

PATENT NO. : 6,406,266 B1
DATED : June 18, 2002
INVENTOR(S) : Hugenroth et al.

It is certified that error appears in the above-identified patent and that said Letters Patent is hereby corrected as shown below:

Title page,
Item [75], Inventors, "Edward A. Tamayko" should read -- Edward A. Tomayko --

Signed and Sealed this

Fourth Day of February, 2003

JAMES E. ROGAN
*Director of the United States Patent and Trademark Office*